United States Patent [19]

Tanaka et al.

[11] 4,136,716

[45] Jan. 30, 1979

[54] AIR GUIDING COMB TOOTH FOR AIR JET WEAVING LOOM

[75] Inventors: Shigenori Tanaka, Hachioji; Akio Tojo, Higashi-murayama; Takao Honya, Koganei, all of Japan

[73] Assignee: Nissan Motor Company, Limited, Japan

[21] Appl. No.: 850,383

[22] Filed: Nov. 10, 1977

[30] Foreign Application Priority Data

Nov. 12, 1976 [JP] Japan ..... 51-135151

[51] Int. Cl.[2] ..... D03D 47/30

[52] U.S. Cl. ..... 139/435

[58] Field of Search ..... 139/435, 188

[56] References Cited

U.S. PATENT DOCUMENTS 3,742,973 7/1973 Kakac ..... 139/435

FOREIGN PATENT DOCUMENTS 1269356 4/1972 United Kingdom ..... 139/435

*Primary Examiner*—Henry Jaudon

*Attorney, Agent, or Firm*—Robert E. Burns; Emmanuel J. Lobato; Bruce L. Adams

[57] ABSTRACT

Straight and arcuate members define an aperture through which a weft yarn is carried by a jet stream of pressurized air. The leading end of the arcuate member closely approaches the straight member to form an exit slot through which the weft yarn is permitted to pass on exit of the same. A flat spring member is arranged to extend from the arcuate member toward the straight member to close the exit slot and is provided with a screen which fluidly seals the space between the flat spring member and the arcuate member.

5 Claims, 10 Drawing Figures

AIR GUIDING COMB TOOTH FOR AIR JET WEAVING LOOM

FIELD OF THE INVENTION

The present invention relates in general to an air jet weaving loom and more particularly to improvements in an air guiding comb tooth which is adapted to guide a weft yarn picked by a stream of pressurized air ejected from an air jet nozzle through the open shed of warp yarns.

BACKGROUND OF THE INVENTION

In an air jet wearing loom, it is conventional to use, for picking or penetration of the weft yarn into the shed of warp yarns, an air guiding comb composed of a row of aligned air guiding teeth. The comb is formed with an air guiding passage, defined by apertures respectively formed in the teeth, through which the weft yarn passes during operation of the loom. Each of the teeth is formed to have a straight part and an arcuate part which are combined to form the aperture leaving an exit slot between the straight part and the leading end of the arcuate part. Recently, it has been proposed to provide such air guiding teeth with flat spring members which extend from the arcuate parts to substantially close the respective exit slots during penetration of the weft yarn into the air passage of the comb and to open the exit slots upon exit thereof therethrough. Actually, such a tooth equipped with the flat spring member has exhibited fairly good result in regard to reduction of losses of energy of the air stream passing through the air passage of the comb.

However, the air guiding tooth of this type has a serious drawback, which is that, upon penetration of the weft yarn into the air passage of the comb, a part of the pressurized air stream is caused to flow or leak through a clearance which is formed near the exit slot between the arcuate part and the flat spring member. This causes a leading end or edge of the travelling weft yarn to be conducted toward the clearance and finally entangled with the flat spring member and/or the arcuate part. This means the failure of the penetration of the weft yarn through the air passage of the guiding comb.

SUMMARY OF THE INVENTION

Therefore, an object of the present invention is to eliminate the drawback encountered in the conventional air guiding comb tooth mentioned above.

Another object of the present invention is to provide an improved air guiding comb tooth which has a screen sealing the clearance between the arcuate part and the flat spring member so that the undesirable air leakage or flow therethrough is prevented.

According to the present invention, there is provided an air guiding comb tooth for an air jet weaving loom, comprising: a body forking into a substantially straight part and an arcuate part which are combined to form an aperture through which a weft yarn is adapted to pass, and to leave an exit slot between the straight part and the leading end of the arcuate parts; a flat spring member extending from an inner surface of the arcuate part toward an inner surface of the straight part so as to substantially close the exit slot; and a screen arrangement for substantially sealing the clearance defined between the leading end of the arcuate part and the flat spring member while permitting the flat spring member to be deformed to open the exit slot when the flat spring member is flexed toward the leading end of the arcuate part.

DESCRIPTION OF THE DRAWINGS

Other objects and advantages of the present invention will become apparent from the following detailed description when taken in conjunction with the accompanying drawings, in which.

DESCRIPTION OF THE PREFERRED EMBODIMENTS

Figure 1:
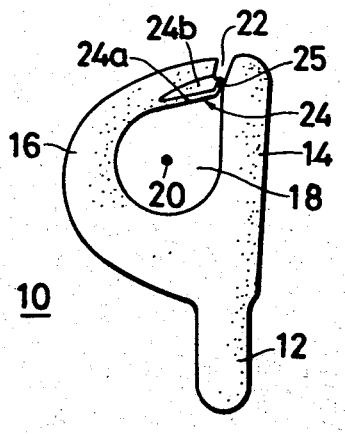
FIG. 1 is a front elevational view of a first preferred embodiment, of an air guiding comb tooth, according to the present invention, the view being taken from a downstream position thereof with respect to the direction of flow of the pressurized air stream.

Referring to FIGS. 1 to 3*b*, especially to FIG. 1, there is illustrated an improved air guiding comb tooth, forming a first preferred embodiment of the invention, which is generally designated by numeral 10. The view of the tooth 10 is taken from a downstream position with respect to the pressurized air stream ejected from an air jet nozzle (not shown). Thus, in the drawings, the pressurized air stream flows or advances perpendicularly out of the plane defined by the surface of the paper on which the drawings are carried. The tooth 10 shown has a body with a stem 12, the body forking in its upper part into a first, straight part 14 and a second, arcuate part 16. The stem 12 of the tooth 10 is fixed in a well known manner on a slay (not shown) which supports a reed (not shown). The straight and arcuate parts 14 and 16 form a substantially circular aperture 18 through which a weft yarn 20 is passed, and leave an exit slot 22 defined between respective leading ends of the parts 14 and 16. The arcuate part 16 is provided near the leading end thereof with sealing means 24 which is constructed of a resilient material and projects toward the exit slot 22 as shown. As will be well stated in the following description, the sealing means 24 functions to almost close the exit slot 22 while the weft yarn is travelling through the aperture 18 and to open the exit slot 22 upon exodus of the weft yarn 20 from the aperture 18 and furthermore to restrict the leakage of the pressurized air from the aperture 18 during the weft yarn penetration.

Figure 2:
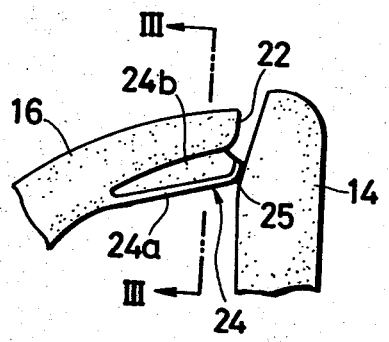
FIG. 2 is an enlarged fragmentary view of a portion of the tooth shown in FIG. 1.

As seen in the drawings, the sealing means 24 substantially consists of a flat spring portion **24*a* extending from an inner surface of the arcuate part 16, and a thin screen or web portion 24*b* arranged to cover the clearance (no numeral) defined by the flat spring portion 24a (in an undeflected state) and the inner surface of the leading end of the arcuate part 16. A leading end 25 of the flat spring portion 24a is bent radially outwardly with respect to the aperture 18 of the tooth 10 so as to form a small clearance (no numeral) between the outer surface thereof and the inner surface of the leading end of the straight part 14 in the undeflected or rest state thereof. However, if desired, the leading bent end 25 may be constructed to contact the inner surface of the straight part 14 in its undeflected state. Preferably, the sealing means 24 is integrally moulded with the arcuate part 16 to allow a one piece construction of the tooth 10. It should be noted that the thickness of the web portion 24b is such sized as to permit the same to be readily flexed when the flat spring portion 24a is forced to bend toward the arcuate part 16 (that is in a counterclockwise direction as seen in FIG. 2) by the weft yarn 20 upon exodus thereof from the aperture 18. Thus, the web portion 24b** is preferably arranged to be a thin film.

Figure 3A:
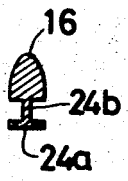
FIG. 3*a* is a sectional view taken along the line III—III of FIG. 2.
Figure 3B:
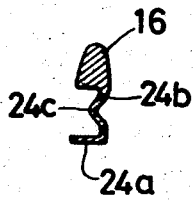
FIG. 3*b* is a view similar to FIG. 3*a*, but shows cross section of a second possible configuration of the arcuate part and the flat spring member.

By the provision of the web portion 24b in the tooth 10, the undesirable air leakage which has occurred at the clearance between the flat spring member and the arcuate part of the conventional tooth mentioned above is no longer possible thereby solving the problem in which the leading end or edge of the travelling weft yarn is accidentally entangled with the flat spring member and/or the arcuate part. This induces smooth and reliable penetration of the weft yarn through the air passage of the air guiding comb. If the web portion 24b is formed to have at least one corrugation 24c as seen in FIG. 3b, the flexibility of the web portion 24b is notably increased. Thus, in this first embodiment, the sealing means 24 can be integrally molded with the main part of the tooth 10 by the use of a simple moulding technic, whereby the manufacturing cost of the teeth 10 is considerably reduced.

Figure 4:
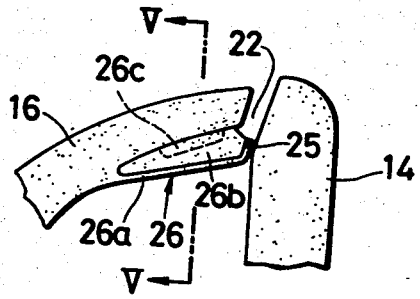
FIG. 4 is a view similar to FIG. 2, but shows a second preferred embodiment of the present invention.
Figure 5:
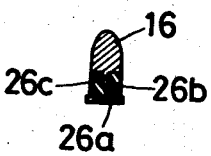
FIG. 5 is a sectional view taken along the line V—V of FIG. 4.

FIGS. 4 and 5 show a second preferred embodiment of the present invention. For facilitation of the description, substantially same parts or portions are designated by the same numerals as in the case of the first embodiment. In the second embodiment, the sealing means is denoted by numeral 28, which consists of a flat spring portion 26a having substantially same construction as one 24a of the first embodiment, a flexible sponge member 26b bonded to the inner surface of the flat spring portion 26a, and a rib 26c integrally formed with and projecting from the inner surface of the leading end of the arcuate part 16 so as to be received in a groove (no numeral) formed in the sponge member 26b. Applying adhesive or any other suitable bonding technique may be applied to bond the rib 26c and the sponge member 26b.

By the provision of the flexible sponge member 26b, the unwanted air leakage is also prevented in this case.

Figure 6:
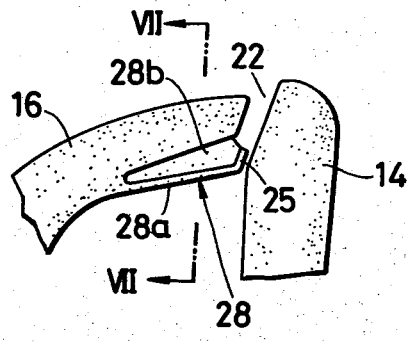
FIG. 6 is a view similar to FIG. 2, but shows a third preferred embodiment of the invention.
Figure 7:
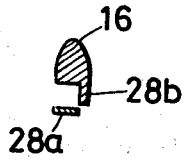
FIG. 7 is a sectional view taken along the line VII—VII of FIG. 6.

FIGS. 6 and 7 show a third preferred embodiment of the invention. In this embodiment, the sealing means is denoted by numeral 28 and consists of a flat spring portion 28a extending from the arcuate part 16 and a rib 28b which extends downwardly from the right or upstream side of the arcuate part 16 to substantially cover the clearance defined between the arcuate part 16 and the flat spring portion 28a. It should be noted, in this embodiment, that the rib 28b is so arranged that even when the flat spring portion 28a is fully deflected during the exodus of the weft yarn 20 from the aperture 18, the leading edge or end of the rib 28b does not extend beyond the innermost surface of the flat spring portion 28a, viz, the lower surface of the portion 28a as seen in FIGS. 6 and 7. With this, it is impossible for the weft yarn 20 to come into contact with the rib portion 28b during the operation of loom. Furthermore, as will be appreciated from the drawings, when the flat spring portion 28a is in its undeflected state or rest portion, the gap between the spring portion 28a and the rib portion 28b is quite small and therefore, any leakage of the pressurized air therethrough is severely restricted or eliminated via a labyrinth seal thus provided. Since the movement of the flat spring portion 28a is not affected by the rib 28b in this embodiment, the deflection of the flat spring portion 28a is totally unrestricted so that the exodus of the weft yarn 20 from the aperture 18 is facilitated.

Figure 8:
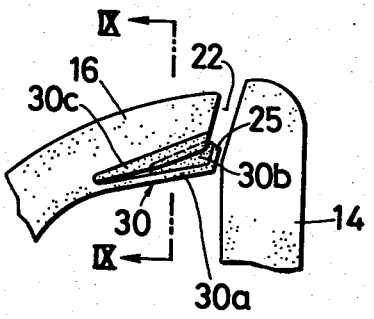
FIG. 8 is a view similar to FIG. 2, but shows a fourth preferred embodiment of the present invention.
Figure 9:
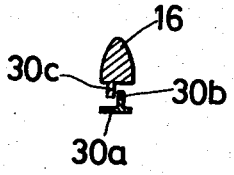
FIG. 9 is a sectional view taken along the line IX—IX of FIG. 8.

FIGS. 8 and 9 show a fourth preferred embodiment according to the present invention. In this case, the sealing means is designated by numeral 30 and substantially consists of a flat spring portion 30a extending from the arcuate part 16, a first rib 30b upwardly extending from a leading section or upstream edge of the flat spring portion 30a, and a second rib 30c downwardly extending from the lower surface of the trailing or downstream edge of the arcuate part 16 permitting the downwardly extending end thereof to juxtapose the upwardly extending end of the first rib 30b. As will be best seen in FIG. 9, the first and second ribs 30b and 30c are so arranged that the respective extending ends thereof overlap each other to allow sufficient deflection of the flat spring portion 30a during the exodus of the weft yarn 20 from the aperture 18. Thus, in this embodiment, the deflection of the flat spring portion 30a is also unrestricted without being affected by the second rib 30c. Although, there is provided a gap between the first and second ribs 30b and 30c, as seen in FIG. 9, through which air can pass as seen in FIG. 9, the leakage of the pressurized air therethrough is severely restricted or almost eliminated by the labyrinch seal effect.

From the above-stated description, it will be appreciated that the air guiding tooth member provided with the combination of that spring member and associated screen according to the present invention can eliminate the drawback regarding to the entanglement of the leading end of the weft yarn with the flat spring member and/or the arcuate part of the tooth.

What is claimed is:

1. An air guiding comb tooth for an air jet weaving loom, comprising:

a body forking into a substantially straight part and an arcuate part which are combined to form an aperture through which a weft yarn is adapted to pass, and to leave an exit slot between said straight part and the leading end of said arcuate part;

a flat spring member extending from an inner surface of said arcuate part toward an inner surface of said straight part so as to substantially close said exit slot; and screen means for substantially covering the clearance defined between said arcuate part and said flat spring member while permitting said flat spring member to be sufficiently deformable to open said exit slot when said flat spring member is flexed toward said arcuate part.

2. An air guiding comb tooth for an air jet weaving loom, comprising:

a body forking into a substantially straight part and an arcuate part which are combined to form an aperture through which a weft yarn is adapted to pass, and to leave an exit slot between said straight part and the leading end of said arcuate part;

a flat spring member extending from an inner surface of said arcuate part so as to substantially close said exit slot;

screen means for substantially covering the clearance defined between said arcuate part and said flat spring member while permitting said flat spring member to be sufficiently deformable to open said exit slot when said flat spring member is flexed toward said arcuate part, and said screen means being constructed of a resilient material.

3. An air guiding comb tooth for an air jet weaving loom, comprising:

a body forking into a substantially straight part and an arcuate part which are combined to form an aperture through which a weft yarn is adapted to pass, and to leave an exit slot between said straight part and the leading end of said arcuate part;

a flat spring member extending from an inner surface of said arcuate part so as to substantially close said exit slot; and screen means for substantially covering the clearance defined between said arcuate part and said flat spring member while permitting said flat spring member to be sufficiently deformable to open said exit slot when said flat spring member is flexed toward said arcuate part, said screen means being a film which is integrally molded with said body.

4. An air guiding comb tooth for an air jet weaving loom, comprising:

a body forking into a substantially straight part and an arcuate part which are combined to form an aperture through which a weft yarn is adapted to pass, and to leave an exit slot between said straight part and the leading end of said arcuate part;

a flat spring member extending from an inner surface of said arcuate part so as to substantially close said exit slot; and screen means for substantially covering the clearance defined between said arcuate part and said flat spring member while permitting said flat spring member to be sufficiently deformable to open said exit slot when said flat spring member is flexed toward said arcuate part, said screen means comprising a rib which is integral with said arcuate part and extends from said arcuate part toward a lateral side of said flat spring member.

5. An air guiding comb tooth for an air jet weaving loom, comprising:

a body forking into a substantially straight part and an arcuate part which are combined to form an aperture through which a weft yarn is adapted to pass, and to leave an exit slot between said straight part and the leading end of said arcuate part;

a flat spring member extending from an inner surface of said arcuate part so as to substantially close said exit slot; and screen means for substantially covering the clearance defined between said arcuate part and said flat spring member while permitting said flat spring member to be sufficiently deformable to open said exit slot when said flat spring member is flexed toward said arcuate part;

said screen means comprising a first rib extending from said flat spring member toward an inner surface of said arcuate part and a second rib extending from said inner surface of said arcuate part toward said flat spring member, said first and second ribs spacedly overlapping each other at their leading ends.

* * * * *